US006756008B2

(12) United States Patent
Sudo

(10) Patent No.: US 6,756,008 B2
(45) Date of Patent: Jun. 29, 2004

(54) CYLINDRICAL VIAL WITH BOTTOM FOR MEDICINE

(75) Inventor: Morihiro Sudo, Tokyo (JP)

(73) Assignee: Daikyo Seiko, Ltd., Tokyo (JP)

( * ) Notice: Subject to any disclaimer, the term of this patent is extended or adjusted under 35 U.S.C. 154(b) by 0 days.

(21) Appl. No.: 10/143,409

(22) Filed: May 9, 2002

(65) Prior Publication Data

US 2002/0128627 A1 Sep. 12, 2002

Related U.S. Application Data

(62) Division of application No. 09/881,368, filed on Jun. 14, 2001, now abandoned.

(30) Foreign Application Priority Data

Jul. 4, 2000 (JP) ..... 2000-201936

(51) Int. Cl.[7] ..... B29C 45/00
(52) U.S. Cl. ..... 264/328.1
(58) Field of Search ..... 264/328.1

(56) References Cited

U.S. PATENT DOCUMENTS 3,770,155 A 11/1973 Novitch
4,745,907 A * 5/1988 Russel et al. ..... 600/4
4,942,008 A * 7/1990 Cahill ..... 264/150
4,977,005 A 12/1990 Krishnakumar et al.
5,340,304 A * 8/1994 Nakamura ..... 425/577
5,344,036 A 9/1994 Stanescu et al.
5,346,659 A * 9/1994 Buhler et al. ..... 264/68
5,443,767 A * 8/1995 Cahill ..... 264/37.31
5,470,537 A 11/1995 Siegel
6,033,615 A 3/2000 Bruening
6,066,299 A 5/2000 Lodge
6,077,471 A * 6/2000 Montgomery ..... 264/318

FOREIGN PATENT DOCUMENTS

GB 697426 9/1953

* cited by examiner

*Primary Examiner*—Michael Colaianni
*Assistant Examiner*—Monica Fontaine
(74) *Attorney, Agent, or Firm*—McCormick, Paulding & Huber LLP

(57) ABSTRACT

A cylindrical vial having a bottom, for a medicine, in which an open end of the cylindrical vial is sealed by a needle-penetrable rubber closure through which a needle can be penetrated, the cylindrical vial including a conical bottom end provided opposite to the open end, wherein the apex of the conical bottom end is located on a central axis of the cylindrical vial at the bottommost point inside the cylindrical vial.

2 Claims, 2 Drawing Sheets

CYLINDRICAL VIAL WITH BOTTOM FOR MEDICINE

This application is a divisional of application Ser. No. 09/881,368, filed on Jun. 14, 2001.

BACKGROUND OF THE INVENTION

1. Field of the Invention

The present invention relates to a cylindrical vial, with a bottom for a medicine, in which an opening is closed by a rubber closure (needle-penetrable rubber closure) which can be penetrated therethrough with a syringe needle.

2. Description of the Related Art

In general, a vial for a medicine is in the form of a cylinder with a bottom. The vial is provided at its one end with an opening which is closed by a rubber closure made of a rubber material, such as butyl rubber, after the vial is filled with a predetermined quantity of liquid medicament. When the liquid medicament is used, a syringe needle is penetrated into the rubber closure to aspirate the liquid medicament into the syringe. In the aspiration operation, the internal liquid medicament of the vial must be completely transferred into the syringe. Namely, a dosage of liquid medicament is contained in the vial, and hence, if the entirety of the liquid medicament contained in the vial fails to be aspirated, there is a possibility that the expected effect of the dosage of liquid medicament is not achieved.

Therefore, a doctor or nurse carefully carries out the aspiration operation of the liquid medicament in the vial. In a conventional vial, in order to aspirate the liquid medicament in the vial completely, it is necessary to incline the vial at the end of the inspiration operation and to move the front end of the syringe needle to the deepest portion of the vial, i.e., the corner portion of the bottom of the vial to thereby aspirate the liquid medicament remaining therein.

It is an object of the present invention to provide a cylindrical vial with a bottom, for a medicine, in which the entirety of liquid medicament in the vial can be completely and easily aspirated by a syringe, without need of inclination of the vial so as to aspirate the liquid medicament remaining at a corner portion of the bottom of the vial by the syringe whose front end is moved to the corner portion.

SUMMARY OF THE INVENTION

The inventors have conceived that if the needle which is penetrated into a vial through a needle-penetrable rubber closure is automatically brought to the deepest or innermost portion of the vial on the center axis thereof, it is possible to easily aspirate the whole quantity of liquid medicament in the vial into the syringe. Namely, in order to achieve the above object, a cylindrical vial having a bottom, for a medicine, in which an open end of the cylindrical vial is sealed by a needle-penetrable rubber closure through which a needle can be penetrated, the cylindrical vial including a conical bottom end provided opposite to the open end, wherein the apex of the conical bottom end is located on a central axis of the cylindrical vial at the bottommost point inside the cylindrical vial.

In general, a conventional cylindrical vial having a bottom is made of a resin material by blow molding. However, it is difficult to precisely form the conical bottom end by the blow molding. To solve this problem, in an embodiment, the cylindrical vial is formed using an injection molding die assembly including a core pin, the core pin being in the form of a rod having a uniform diameter and having a conical front end. Dies other than the core pin are not limited to a specific shape or structure and can be of any structure.

In another embodiment, the cylindrical vial is formed using an injection molding die assembly including a core pin, the core pin being in the form of a tapered rod having a conical front end and having an outer diameter gradually increasing from the conical front end toward the other end thereof. Dies other than the core pin are not limited to a specific shape or structure and can be of any structure.

To make it possible to aspirate the whole quantity of liquid medicament in the cylindrical vial by a needle of a syringe without inclining the cylindrical vial, the conical bottom end of the cylindrical vial preferably defines an angle in the range of 30° through 70° between the generatrix of the conical bottom end and the central axis of the cylindrical vial. If the angle is less than 30°, it is necessary to increase the length of the cylindrical vial in order to provide the same capacity as that of a conventional cylindrical vial, and there is a possibility that the needle cannot reach the deepest or innermost portion of the cylindrical vial. Furthermore, since the mass of resin of which the bottom portion of the cylindrical vial is increased, the cylindrical vial becomes heavy. If the angle exceeds 70°, no effect expected from the conical shape can be obtained.

According to another aspect of the present invention, a cylindrical vial for a medicine is provided, including an axial hollow portion, an open end connected to the axial hollow portion and a closed end opposite to the open end. The open end is sealed by a needle-penetrable rubber closure through which a needle can be penetrated into the cylindrical vial. The closed end includes a conical bottom end, the apex of the conical bottom end being located on a central axis of the axial hollow portion at the bottommost point inside the axial hollow portion.

In an embodiment, the axial hollow portion is formed using an injection molding die assembly including a core pin, the core pin being in the form of a rod having a uniform diameter and having a conical front end.

In another embodiment, the axial hollow portion is formed using an injection molding die assembly including a core pin, the core pin being in the form of a tapered rod having a conical front end and having an outer diameter gradually increasing from the conical front end toward the other end thereof.

Preferably, the conical bottom end of the cylindrical vial defines an angle in the range of 30° through 70° between the generatrix of the conical bottom end and the central axis of the axial hollow portion.

The present disclosure relates to subject matter contained in Japanese Patent Application No.2000-201936 (filed on Jul. 4, 2000) which is expressly incorporated herein by reference in its entirety.

BRIEF DESCRIPTION OF THE DRAWINGS

The invention will be discussed below in detail with reference to the accompanying drawings, in which.

DESCRIPTION OF THE PREFERRED EMBODIMENT

Figure 1:
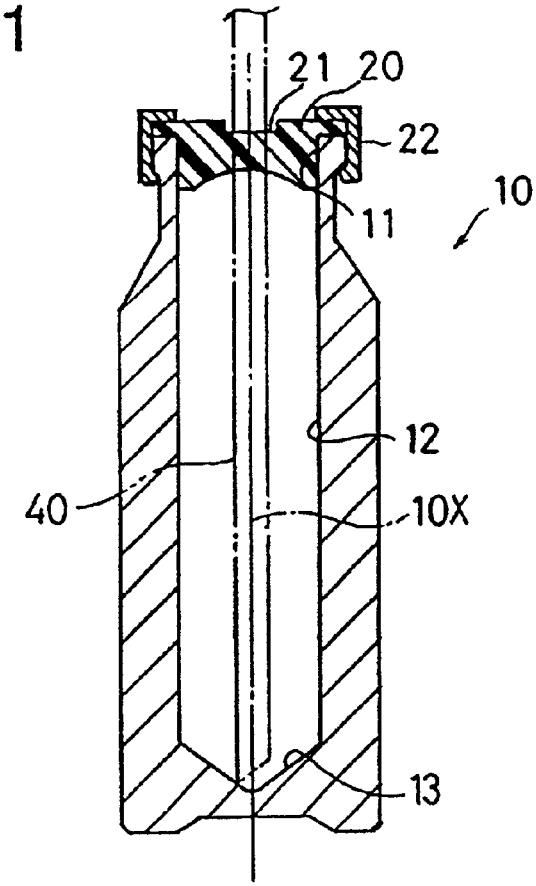
FIG. 1 is a longitudinal sectional view of an embodiment of a vial for a medicine in which an open end is sealed by a needle stickable rubber closure, according to the present invention.

FIG. 1 shows a bottomed cylindrical vial 10 which is filled with a liquid medicament, according to an embodiment of the present invention. The cylindrical vial 10 is long and elongated and is provided with a closed end and an open end 11 which is closed by a rubber closure (needle-penetrable rubber closure) 20. The rubber closure 20 is provided on its center portion with a reduced thickness portion 21 through which a needle of a syringe can be penetrated. The rubber closure 20 is secured, in a liquid-tight fashion, to the open end 11 by a retainer (rubber closure holding member) 22.

Figure 2:
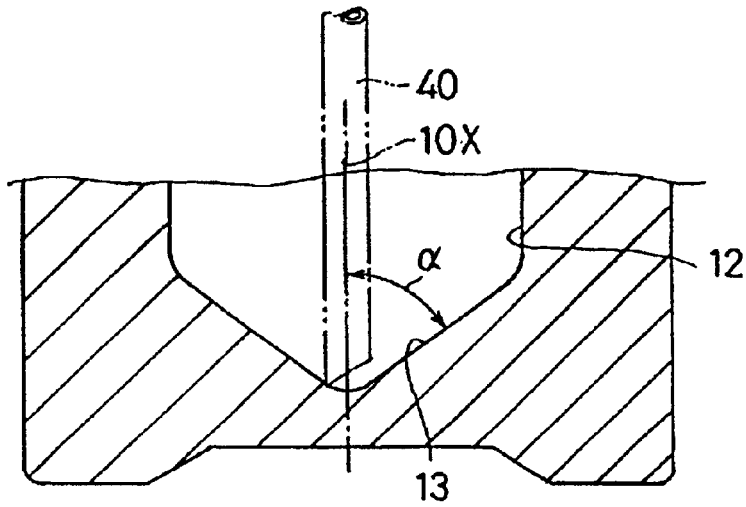
FIG. 2 is an enlarged view of a lower portion of FIG. 1.

The axial hollow portion 12 of the bottomed cylindrical vial 10 has a rotationally symmetrical shape with respect to the axis 10X of the cylindrical vial 10 and has a uniform diameter over the overall length thereof from the open end 11 to a conical bottom 13 thereof. The conical bottom 13 is deepest at the apex of the cone located on the axis 10X and gradually decreases the depth toward the periphery thereof. The angle $\alpha$ (FIG. 2) defined between the generatrix of the conical bottom 13 and the axis 10X is preferably in the range of 30° to 70°, from the viewpoint of facilitation of use, and is more preferably in the range of 40° to 60°.

Figure 3:
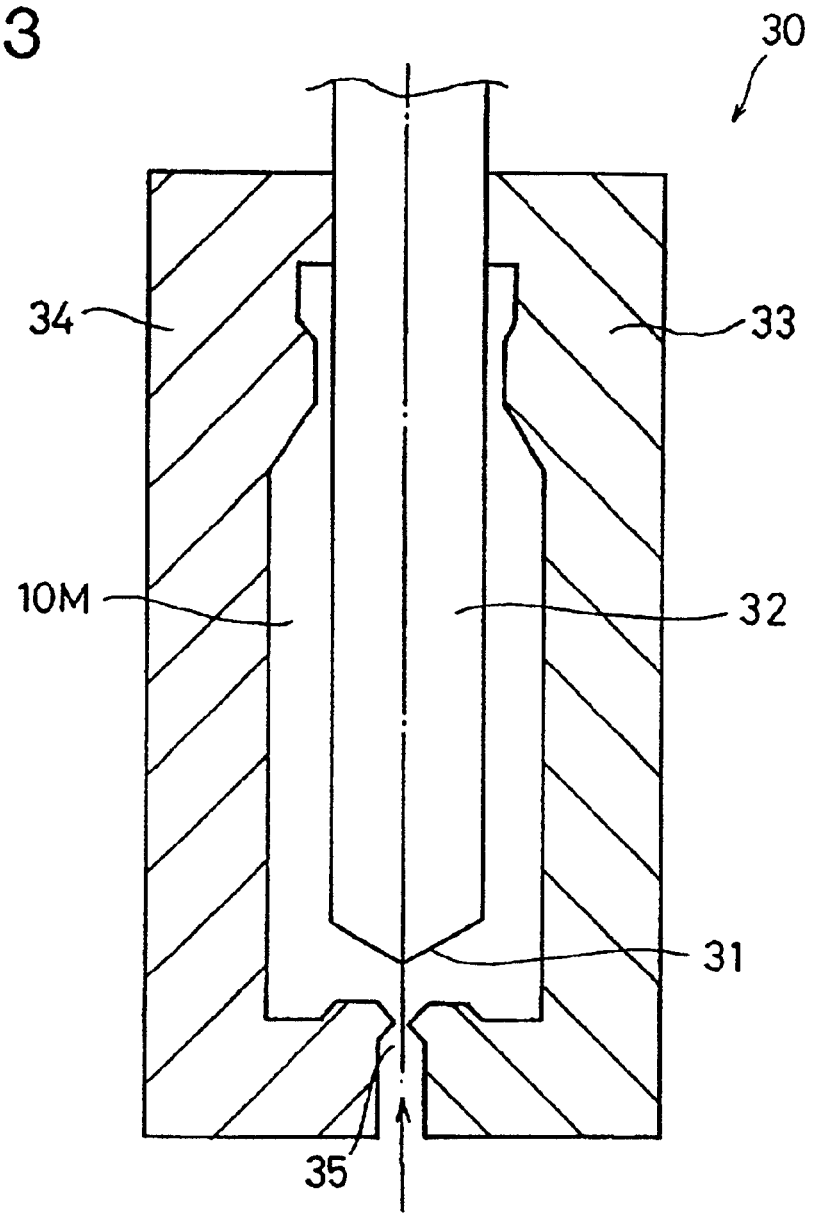
FIG. 3 is a schematic sectional view of an injection molding die assembly for producing a vial for a medicine, according to the present invention.

The bottomed cylindrical vial 10 is made of a resin material by injection molding. FIG. 3 schematically shows an injection molding die assembly. The injection molding die assembly 30 is provided with a core pin (rod-like central die) 32 in the form of a rod whose diameter corresponds to the inner diameter of the axial hollow portion 12 and which has a conical front end 31 formed by rotating a leg of a right triangle about the central axis 10X corresponding to the conical bottom 13, and a pair of right and left split dies 33 and 34 which define therebetween a molding cavity 10M for the bottomed cylindrical vial 10, together with the core pin 32. At least one of the split dies 33 and 34 is provided with a gate 35 through which a molding resin material is introduced into the molding cavity. p Various split structures of the split dies 30 to define the molding cavity 10M can be used, provided that the axial hollow portion 12 is formed by the core pin 32, and that the core pin 32 is provided on its front end with the conical portion 31 corresponding to the conical bottom 13.

The bottomed cylindrical vial 10 for a medicine, which is formed by the injection molding die assembly 30, is washed and is subject to other necessary operations. Subsequently, a liquid medicament is filled in the axial hollow portion 12 of the cylindrical vial 10. Thereafter, the needle-penetrable rubber closure 20 is attached to the open end 11 of the cylindrical vial 10 and is secured thereto by a retainer 22 to seal the open end.

When liquid medicament in the cylindrical vial 10 is used, a needle 40 attached to a syringe is penetrated into the cylindrical vial 10 through the thin portion 21 of the rubber closure 20. The retraction (inward movement) of a plunger in the syringe causes the liquid medicament in the cylindrical vial 10 to be aspirated into the syringe. When the needle 40 is inserted up to the innermost portion of the cylindrical vial 10, the front end of the needle 40 naturally moves to the apex of the cone of the conical bottom 13 while being guided by the conical surface. Since the liquid medicament in the cylindrical vial 10 is collected in the conical bottom 13, substantially all of the liquid medicament in the cylindrical vial 10 can be aspirated by the syringe without needing to incline the cylindrical vial 10.

Although the core pin 32 of the molding die assembly 30 shown in FIG. 3 has a uniform diameter, it is possible to provide the core pin 32 with a tapered peripheral surface for easy release thereof. Namely, the core pin 32 can be in the form of a slightly tapered rod whose outer diameter is gradually increased from the conical end 31 toward the other end. The taper angle should be as small as possible.

As may be understood from the above discussion, according to the present invention, when the liquid medicament in the cylindrical vial with a bottom is aspirated into a syringe by a needle, it is possible to easily aspirate the whole quantity of the liquid medicament without inclining the cylindrical vial.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A method for making a cylindrical vial with an inside volume for containing medicine and having a bottom end with a bottom wall and an upper end with an opening adapted to be sealed by a needle-penetrable rubber closure through which a needle can be penetrated, said method comprising:

forming said cylindrical vial by an injection molding process using an injection molding die assembly including a core pin, said core pin being in the form of a rod having a cylindrical upper portion with a central axis and a uniform diameter and having a conical bottom portion formed by rotating a leg of a right triangle about said central axis with an apex on said central axis so that said vial will have a cylindrical inside surface with a central inside surface axis and said bottom wall of the vial will have a conical surface inside said vial with an apex on said central inside surface axis and defining a bottommost point of the inside volume of the vial.

2. A method for making a cylindrical vial with an inside volume for containing medicine and having a bottom end with a bottom wall and an upper end with an opening adapted to be sealed by a needle-penetrable rubber closure through which a needle can be penetrated, said method comprising:

forming said cylindrical vial by an injection molding process using an injection molding die assembly including a core pin, said core pin being in the form of a rod having a tapered upper portion with a central axis and a conical bottom portion formed by rotating a leg of a right triangle about said central axis with an apex on said central axis, said tapered upper portion of said rod having an outer diameter which gradually increases in going upwardly away from said conical bottom end portion so that said vial will have a tapered inside surface with a central inside surface axis and said bottom wall of the vial will have a conical surface inside said vial with an apex on said central inside surface axis and defining a bottommost point of the inside volume of the vial.

* * * * *